US012215563B2

(12) United States Patent
Qureshi

(10) Patent No.: US 12,215,563 B2
(45) Date of Patent: Feb. 4, 2025

(54) LINER TOP DIAGNOSTIC TOOL

(71) Applicant: Saudi Arabian Oil Company, Dhahran (SA)

(72) Inventor: Muhammad Ali Qureshi, Abqaiq (SA)

(73) Assignee: Saudi Arabian Oil Company, Dhahran (SA)

( * ) Notice: Subject to any disclaimer, the term of this patent is extended or adjusted under 35 U.S.C. 154(b) by 156 days.

(21) Appl. No.: 17/986,593

(22) Filed: Nov. 14, 2022

(65) Prior Publication Data

US 2024/0159122 A1 May 16, 2024

(51) Int. Cl.
*E21B 33/128* (2006.01)
*E21B 23/06* (2006.01)
*E21B 47/117* (2012.01)

(52) U.S. Cl.
CPC ..... *E21B 33/128* (2013.01); *E21B 23/06* (2013.01); *E21B 47/117* (2020.05)

(58) Field of Classification Search
CPC ..... E21B 23/06; E21B 33/128; E21B 47/117; E21B 23/00; E21B 33/12; E21B 47/10
See application file for complete search history.

(56) References Cited

U.S. PATENT DOCUMENTS

| | | | | |
|---|---|---|---|---|
| 11,680,459 | B1 * | 6/2023 | Al-Ramadhan | E21B 34/14 166/285 |
| 2005/0230108 | A1 * | 10/2005 | Mackenzie | E21B 47/117 166/250.01 |
| 2017/0037723 | A1 | 2/2017 | Schultz et al. | |
| 2021/0062622 | A1 * | 3/2021 | Pace | E21B 34/06 |
| 2022/0205331 | A1 * | 6/2022 | Xu | E21B 17/042 |
| 2023/0068446 | A1 * | 3/2023 | Saleh | E21B 47/06 |
| 2024/0159122 | A1 * | 5/2024 | Qureshi | E21B 47/117 |

* cited by examiner

*Primary Examiner* — Daniel P Stephenson
(74) *Attorney, Agent, or Firm* — Fish & Richardson P.C.

(57) ABSTRACT

Systems and methods include a method for testing in a well. Inflow packers are run into a hole in locked position downhole. A liner top diagnostic tool is run on a drill pipe to a desired depth. A lower-packer-sized ball is dropped into the well to activate a lower inflow packer assembly. A back side of the lower inflow packer assembly is pressure-tested to ensure seal integrity. The lower inflow packer is unset by withdrawing string weight while rotating the string. The drill string is displaced to test fluid to the end of the string, and weight and rotation are applied again to set the lower inflow packer. A Homer plot is established based on an inflow test. A deactivation-sized ball is dropped to deactivate the lower include packer assembly. An upper inflow packer assembly is activated using upper-packer-sized ball. A leak is identified based on testing both liner tops.

20 Claims, 3 Drawing Sheets

LINER TOP DIAGNOSTIC TOOL

TECHNICAL FIELD

The present disclosure applies to identifying leaks in wells, such as oil and gas wells.

BACKGROUND

In the petroleum industry (e.g., for gas and oil wells), conventionally-available test packers for liner tops sit in host casing such as a 9⅝-inch casing and are not available in smaller sizes. In case one of the liner top develops a leak during inflow testing, the individual liner tops need to be tested sequentially with different-sized test packers to diagnose the location of the leak, after which remedial actions can occur. This type of diagnosis and subsequent action is a time-consuming process.

For example, it is typical that the last liner string that is run in a hole is a 4½-inch liner which sits inside the 7-inch liner. At this stage, the 7-inch liner has already been positive/negative tested at the time of setting and before drilling through it. After setting and cementing the 4½-inch liner, an ITP is run to check the integrity of the liner top. However, the ITP sits above the 7-inch liner (e.g., in the 9⅝-inch casing, and currently-available sizes preclude setting the ITP inside the 7-inch liner. In case a leak is detected during the positive/negative testing, a conclusion cannot be made with certainty that only the 4½-inch liner top is leaking. This is because the 7-inch liner top may have developed a leak. The correct location of the leak must be established prior to proceeding with remedial operations. This is done by a process of elimination and is a time consuming and tedious process.

SUMMARY

The present disclosure describes techniques for using a single tool for testing two liner tops in sequence without having to pull out and run different-sized tools into a wellbore. In some implementations, a computer-implemented method includes the following. Inflow packers are run into a hole in locked position downhole into a well. A liner top diagnostic tool is run on a drill pipe to a desired depth in the well. A lower-packer-sized ball is dropped into the well to activate a lower inflow packer assembly. A back side of the lower inflow packer assembly is pressure-tested to ensure seal integrity. The lower inflow packer is unset by withdrawing string weight while rotating the string. The drill string is displaced to test fluid to the end of the string, and weight and rotation are applied again to set the lower inflow packer. A Homer plot is established based, at least in part, on an inflow test. A deactivation-sized ball is dropped into the well to deactivate the lower include packer assembly. An upper inflow packer assembly is activated using upper-packer-sized ball. A leak is identified based, at least in part on testing both liner tops.

Although the techniques of the present disclosure can be entirely mechanical, the previously described implementation is implementable using a computer-implemented method; a non-transitory, computer-readable medium storing computer-readable instructions to perform the computer-implemented method; and a computer-implemented system including a computer memory interoperably coupled with a hardware processor configured to perform the computer-implemented method, the instructions stored on the non-transitory, computer-readable medium.

The subject matter described in this specification can be implemented in particular implementations, so as to realize one or more of the following advantages. Techniques of the present disclosure can solve the technical problem of testing two liner tops in sequence without having to pull out and run different-sized tools into a wellbore. For example, a tool can be used that contains two packers having, each packer independent activation and de-activation mechanisms to individually set and un-set the packers for positive and negative testing of liner tops.

The details of one or more implementations of the subject matter of this specification are set forth in the Detailed Description, the accompanying drawings, and the claims. Other features, aspects, and advantages of the subject matter will become apparent from the Detailed Description, the claims, and the accompanying drawings.

DESCRIPTION OF DRAWINGS

Like reference numbers and designations in the various drawings indicate like elements.

DETAILED DESCRIPTION

Figure 1:
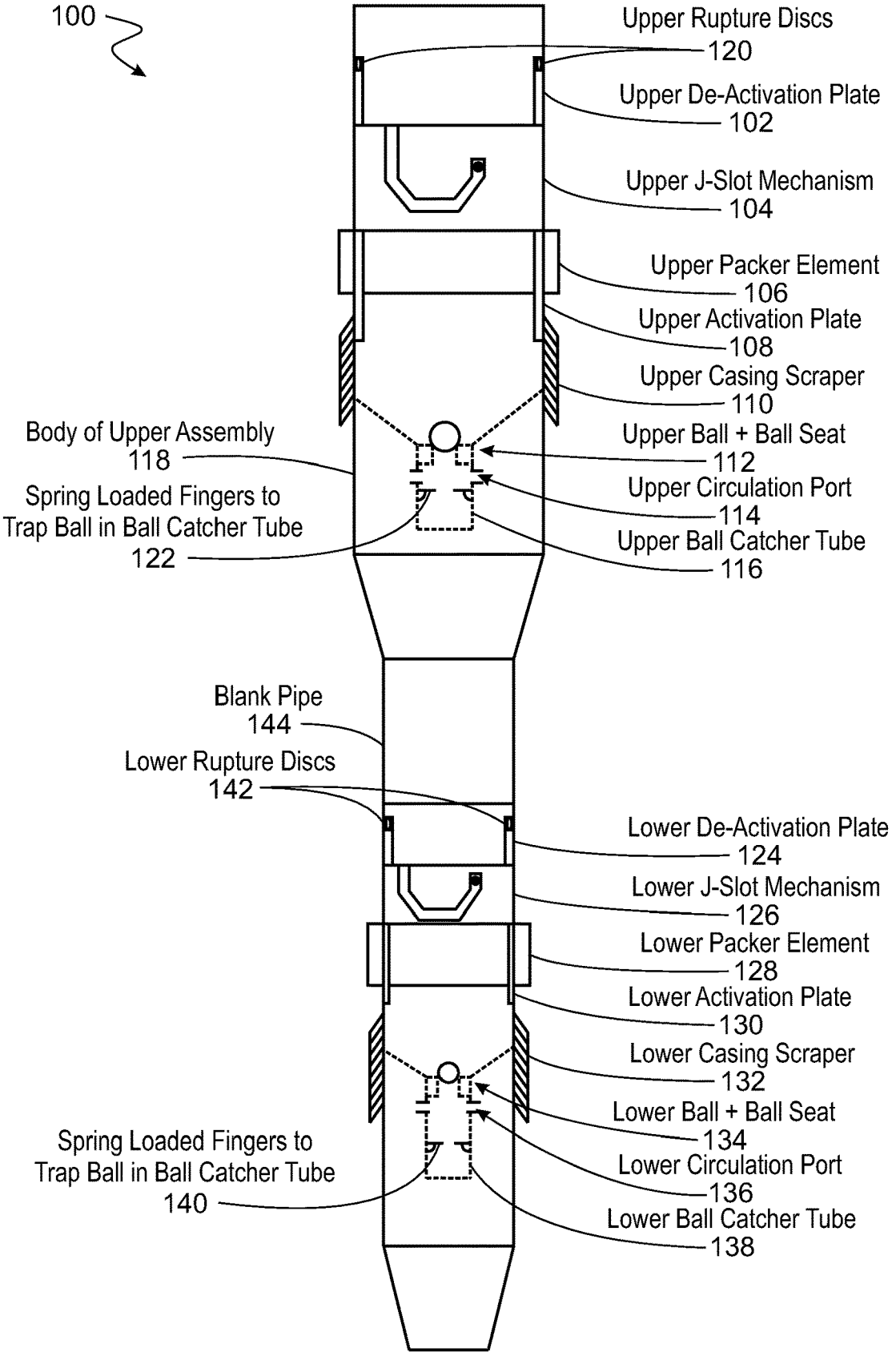
FIG. 1 is a schematic of a liner top diagnostic tool, according to some implementations of the present disclosure.

The following detailed description describes techniques for using a single tool for testing two liner tops in sequence without having to pull out and run different-sized tools into a wellbore. Various modifications, alterations, and permutations of the disclosed implementations can be made and will be readily apparent to those of ordinary skill in the art, and the general principles defined may be applied to other implementations and applications, without departing from the scope of the disclosure. In some instances, details unnecessary to obtain an understanding of the described subject matter may be omitted so as to not obscure one or more described implementations with unnecessary detail and inasmuch as such details are within the skill of one of ordinary skill in the art. The present disclosure is not intended to be limited to the described or illustrated implementations, but to be accorded the widest scope consistent with the described principles and features.

A Liner Top Diagnostic Tool (or "tool") described in the present disclosure allows two liner tops (typically 7 inches and 4½ inches) to be positive-tested and then inflow-tested independently. The tool can be sized to test 9⅝-inch liner tops as well. Use of the tool will save time and money in case there is a leak in one of the liner tops after the lower completion has been run on a 4½-inch liner hanger. The available test packers for liner tops sit in the host casing such as a 9⅝-inch casing and are not available in smaller sizes. In case one of the liner top develops a leak during inflow testing, the individual liner tops have to be tested sequentially with different-sized test packers to diagnose the location of the leak after which remedial actions can be implemented. This diagnosis is a time-consuming process. The Liner Top Diagnostic Tool (LTDT) of the present disclosure allows testing both liner tops in a single run for a quick diagnostic.

Liner strings are parts of casings that are hung inside a host casing and do not extend to the surface. They are run and cemented in place and then pressure-tested to ensure mechanical integrity and to ensure long-term well integrity. The pressure test is performed in both directions, e.g., by increasing pressure inside the wellbore (positive pressure test) and by reducing pressure inside the wellbore (negative test). The negative test simulates an actual production loading condition on the liner top packer. In case there is a leak in either test, the leak must be fixed before proceeding with the next operation.

A liner string is run in the hole to the bottom and cemented in place. Then the liner top packer is set to seal the top of the liner. After this, an inflow test packer is run along with a casing scraper and clean-out tools on the drill pipe to just above the liner top drilling out cement and part of the shoe track on the way down. First, a positive test is performed by closing the blowout preventer (BOP) and applying pressure to the drill string. This pressures up the entire wellbore including the liner top. In case of a leak, this pressure will drop. After a successful pressure test, the BOP is opened and the part of the host casing where the inflow test packer (ITP) will sit is scraped to remove any debris or cement. Then the ITP is set, and its backside is tested to ensure integrity of the ITP seals. Once confirmed, the work string is completely displaced with a lighter test fluid such as water, and the ITP is set again. Since the test fluid is lighter than the drilling mud in the hole, a high-differential pressure exists after the string has been internally displaced with water and just before setting the ITP. After setting, this differential pressure is bled off by opening the valve on top of the drill string, which results in leaving only a column of the test fluid exerting hydrostatic pressure on the liner top packer. This hydrostatic pressure is less than the formation pressure which the liner string is isolating. As a result, if there a leak exists in the liner top packer, the formation fluids will start to flow through channels in the cement sheath. The flow will continue through the leaking liner top packer and into the well bore, lifting up the test fluid and causing flow from inside the work string. Typically, a Homer plot is constructed, from which a conclusion can be determined whether the well is actually flowing or whether ballooning or thermal effects are occurring.

Typically, the last liner string that is run in a hole is a 4½-inch liner which sits inside the 7-inch liner. At this stage, the 7-inch liner has already been positive/negative tested at the time of setting and before drilling through it. After setting and cementing the 4½-inch liner, an ITP is run to check the integrity of the liner top. However, the ITP sits above the 7-inch liner (e.g., in the 9⅝-inch casing, and currently-available sizes preclude setting the ITP inside the 7-inch liner. In case a leak is detected during the positive/negative testing, a conclusion cannot be made with certainty that only the 4½-inch liner top is leaking. This is because the 7-inch liner top may have developed a leak. The correct location of the leak must be established prior to proceeding with remedial operations. This is done by a process of elimination and is a time consuming and tedious process.

Leak detection can be performed by running a Retrievable Test-Treat-Squeeze (RTTS) packer which is set inside the 7-inch liner. The RTTS packer functions similarly to the ITP, however a dedicated scraper trip must be run before running and setting. First, the 4½-inch liner top is inflow tested and fixed in case of a leak. Then another RTTS is run and set inside 9-⅝-inch casing to test the 7-inch liner top again. As before, if a leak is detected, the leak must be fixed prior to proceeding with the next step of the operations.

The LTDT allows independent inflow testing of both the 4½-inch and 7-inch liner tops in a single run. The LTDT contains integral casing scrapers which eliminate the need for dedicated scraper runs. The LTDT contains packers for both 7-inch liner and 9⅝-inch casings in a single string which can be independently set and released in order to allow selective inflow testing.

FIG. 1 is a schematic of Liner Top Diagnostic Tool 100, according to some implementations of the present disclosure. An upper body assembly 118 of the tool 100 includes an upper deactivation plate 102, an upper j-slot mechanism 104, an upper packer element 106, an upper activation plate 108, an upper casing scraper 110, an upper ball+ball seat 112, an upper circulation port 114, an upper ball catcher tube 116, and an upper rupture disks 120, and spring-loaded fingers 122 to trap the ball in the ball catcher tube. The body of the upper body assembly 118 has an outside diameter (OD) that is less than the casing's inside diameter (ID). A lower portion of the tool 100, contained in a blank pipe 144, includes a lower de-activation plate 124, a lower j-slot mechanism 126, a lower packer element 128, a lower activation plate 130, a lower casing scraper 132, a ball+ball seat 134, a lower circulation port 136, a lower ball catcher tube 138, spring-loaded fingers 140 to trap the ball in the ball catcher tube, and lower rupture disks 142. The blank pipe 144 connects the upper assembly of the tool 100 with the lower assembly of the tool 100. The blank pipe 144 can vary in length depending upon the space required between the upper and lower assemblies.

Figure 2:
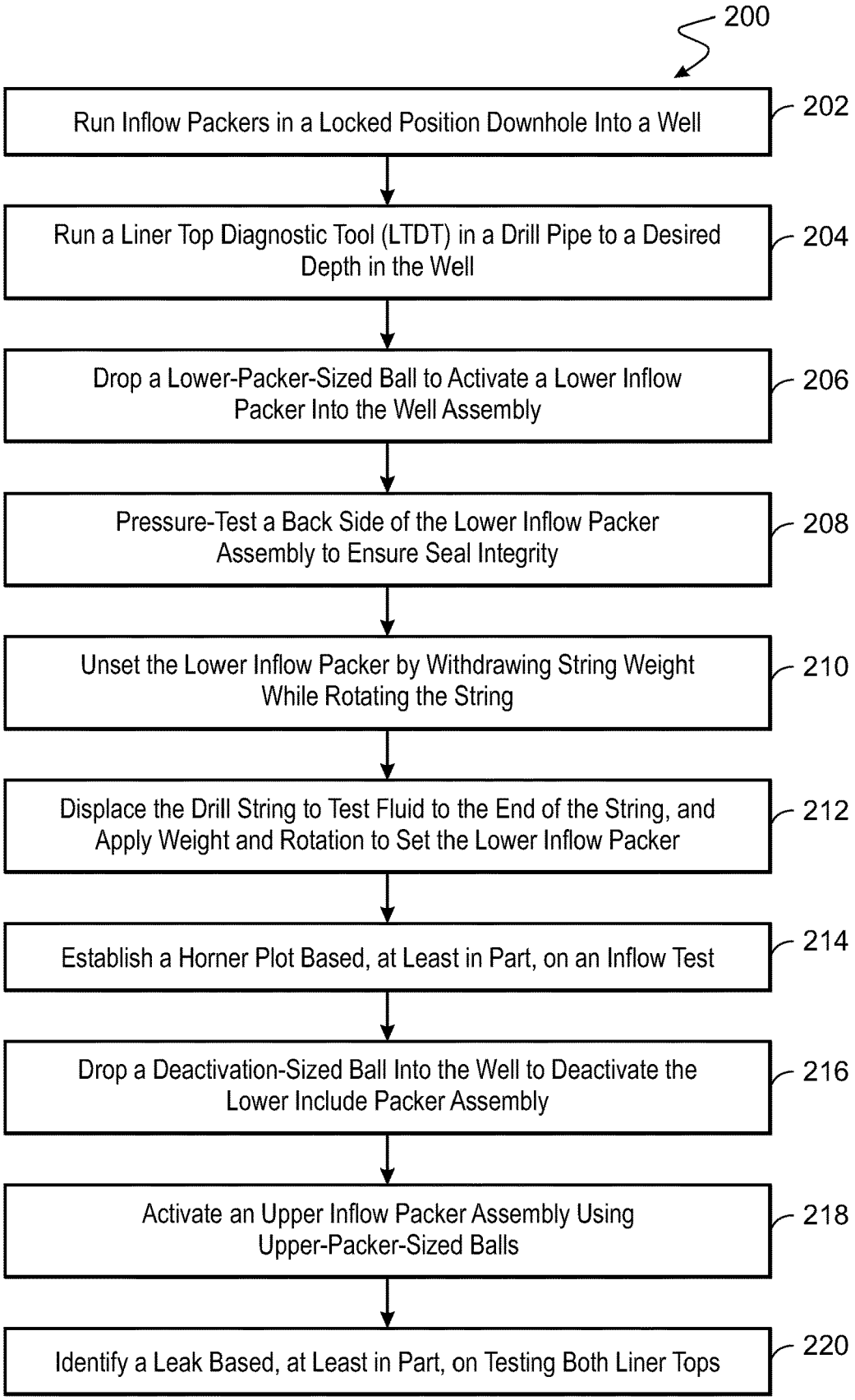
FIG. 2 is a flowchart of an example of a method for using a single tool for testing two liner tops in sequence without having to pull out and run different-sized tools into a wellbore, according to some implementations of the present disclosure.

FIG. 2 is a flowchart of an example of a method 200 for using a single tool for testing two liner tops in sequence without having to pull out and run different-sized tools into a wellbore, according to some implementations of the present disclosure. For clarity of presentation, the description that follows generally describes method 200 in the context of the other figures in this description. However, it will be understood that method 200 can be performed, for example, by any suitable system, environment, software, and hardware, or a combination of systems, environments, software, and hardware, as appropriate. In some implementations, various steps of method 200 can be run in parallel, in combination, in loops, or in any order.

At 202, inflow packers are run in a hole in a locked position downhole into a well. For example, the inflow packers can be activated and de-activated using a ball drop mechanism after being run down the well. From 202, method 200 proceeds to 204.

At 204, a Liner Top Diagnostic Tool (LTDT) is run on a drill pipe to a desired depth in the well. Before activating the lower inflow packer in the next step, the string is reciprocated while circulating to scrape and clean the packer setting area. From 204, method 200 proceeds to 206.

At 206, a lower-packer-sized ball is dropped into the well to activate a lower inflow packer assembly. Once the ball lands in the ball seat, pressure is increased to shear the activation plate which unlocks the J-slot. The string is rotated counter-clockwise, and weight is set down which causes the packer elements to be pushed outwards. Further pressure causes the ball to extrude out of the ball seat and drop into the ball catcher. The ball catcher has spring-loaded fingers to prevent upward movement of the ball in case of flow from below the string. This opens up the pathways inside the ball catcher profile through which fluids can flow downwards or upwards in the string. From 206, method 200 proceeds to 208.

At 208, the back side of the lower inflow packer assembly is pressure-tested to ensure seal integrity. From 208, method 200 proceeds to 210.

At 210, the lower inflow packer is unset by withdrawing string weight while simultaneously rotating the string. This is done clockwise to re-engage the J-slot and to allow the packer elements to relax. Spring-loaded packer blocks can help to retract the individual elements. From 210, method 200 proceeds to 212.

At 212, the drill string is displaced to test fluid to the end of the string, and weight and rotation are applied again to set the lower inflow packer. After 212, method 200 proceeds to 214.

At 214, an inflow test is performed and a Horner plot is established. After a successful test, the string is picked-up and rotated clockwise to retract the packer, and the test fluid is reversed out of the string. If needed, the negative test can be repeated. From 214, method 200 proceeds to 216.

At 216, a deactivation-sized ball is dropped into the well to deactivate the lower include packer assembly. The ball drops in the ball catcher and breaks the rupture disc. This results in exposing and shearing the deactivation plate, which moves downwards essentially locking the lower J-slot mechanism in place. From 216, method 200 proceeds to 218.

At 218, an upper inflow packer assembly is activated using upper-packer-sized balls (a different size than the lower packer balls. Steps 208-216 can be repeated to inflow test the upper liner top. From 218, method 200 proceeds to 220.

At 220, both liner tops are tested, and a leak is identified. Remedial operations to fix the leak can commence. The string can be pulled out-of-hole after both liner tops are tested. After 220, method 200 can stop.

In some implementations, in addition to (or in combination with) any previously-described features, techniques of the present disclosure can include the following. Outputs of the techniques of the present disclosure can be performed before, during, or in combination with wellbore operations, such as to provide inputs to change the settings or parameters of equipment used for drilling. Examples of wellbore operations include forming/drilling a wellbore, hydraulic fracturing, and producing through the wellbore, to name a few. The wellbore operations can be triggered or controlled, for example, by outputs of the methods of the present disclosure. In some implementations, customized user interfaces can present intermediate or final results of the above described processes to a user. Information can be presented in one or more textual, tabular, or graphical formats, such as through a dashboard. The information can be presented at one or more on-site locations (such as at an oil well or other facility), on the Internet (such as on a webpage), on a mobile application (or "app"), or at a central processing facility. The presented information can include suggestions, such as suggested changes in parameters or processing inputs, that the user can select to implement improvements in a production environment, such as in the exploration, production, and/or testing of petrochemical processes or facilities. For example, the suggestions can include parameters that, when selected by the user, can cause a change to, or an improvement in, drilling parameters (including drill bit speed and direction) or overall production of a gas or oil well. The suggestions, when implemented by the user, can improve the speed and accuracy of calculations, streamline processes, improve models, and solve problems related to efficiency, performance, safety, reliability, costs, downtime, and the need for human interaction. In some implementations, the suggestions can be implemented in real-time, such as to provide an immediate or near-immediate change in operations or in a model. The term real-time can correspond, for example, to events that occur within a specified period of time, such as within one minute or within one second. Events can include readings or measurements captured by downhole equipment such as sensors, pumps, bottom hole assemblies, or other equipment. The readings or measurements can be analyzed at the surface, such as by using applications that can include modeling applications and machine learning. The analysis can be used to generate changes to settings of downhole equipment, such as drilling equipment. In some implementations, values of parameters or other variables that are determined can be used automatically (such as through using rules) to implement changes in oil or gas well exploration, production/drilling, or testing. For example, outputs of the present disclosure can be used as inputs to other equipment and/or systems at a facility. This can be especially useful for systems or various pieces of equipment that are located several meters or several miles apart, or are located in different countries or other jurisdictions.

Figure 3:
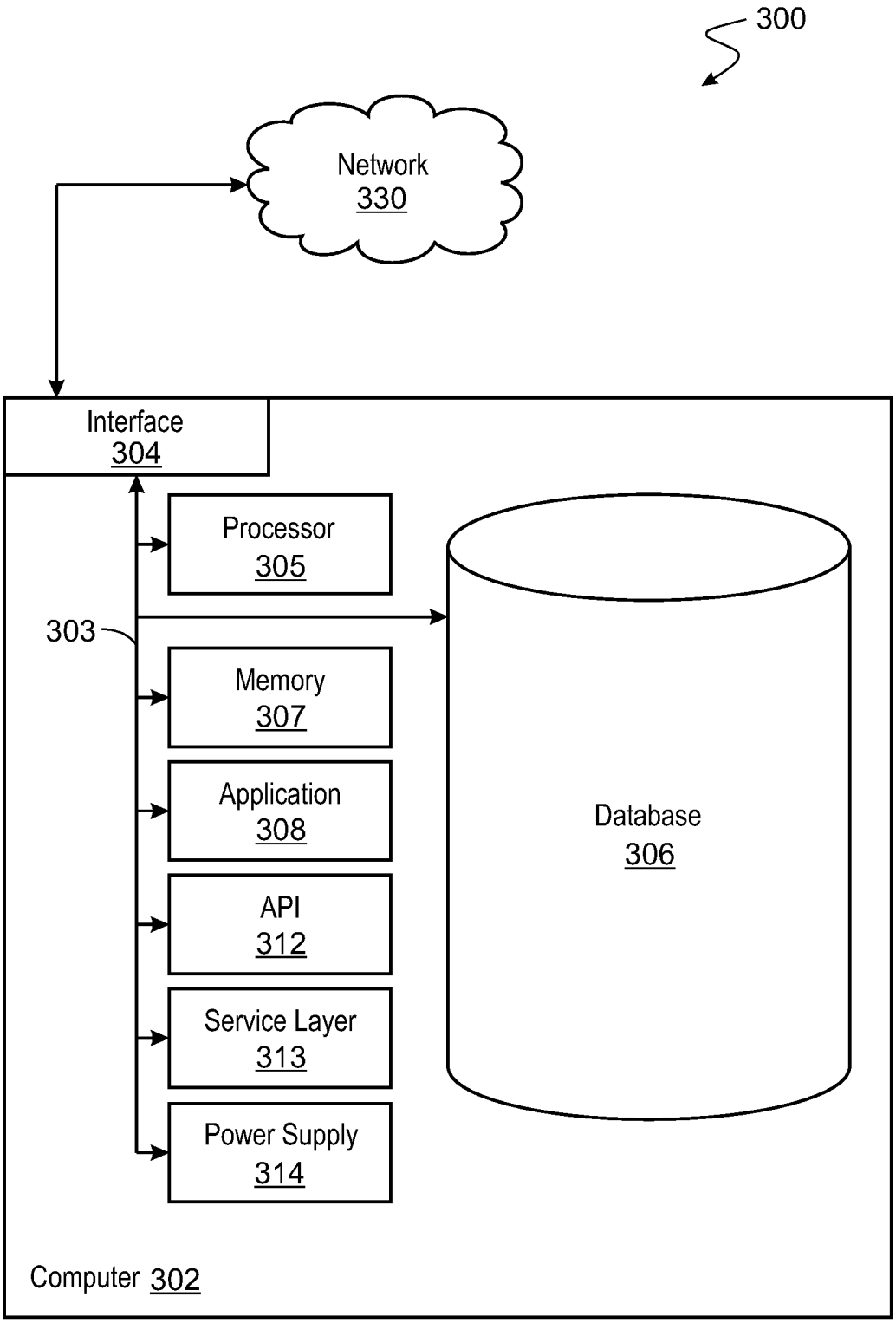
FIG. 3 is a block diagram illustrating an example computer system used to provide computational functionalities associated with described algorithms, methods, functions, processes, flows, and procedures as described in the present disclosure, according to some implementations of the present disclosure.

FIG. 3 is a block diagram of an example computer system 300 used to provide computational functionalities associated with described algorithms, methods, functions, processes, flows, and procedures described in the present disclosure, according to some implementations of the present disclosure. Although the techniques of the present disclosure can be entirely mechanical, computer system 300 can be used for automating at least part of the techniques. The illustrated computer 302 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 302 can include input devices such as keypads, keyboards, and touch screens that can accept user information. Also, the computer 302 can include output devices that can convey information associated with the operation of the computer 302. The information can include digital data, visual data, audio information, or a combination of information. The information can be presented in a graphical user interface (UI) (or GUI).

The computer 302 can serve in a role as a client, a network component, a server, a database, a persistency, or components of a computer system for performing the subject matter described in the present disclosure. The illustrated computer 302 is communicably coupled with a network 330. In some implementations, one or more components of the computer 302 can be configured to operate within different environments, including cloud-computing-based environments, local environments, global environments, and combinations of environments.

At a top level, the computer 302 is an electronic computing device operable to receive, transmit, process, store, and manage data and information associated with the described subject matter. According to some implementations, the computer 302 can also include, or be communicably coupled with, an application server, an email server, a web server, a caching server, a streaming data server, or a combination of servers.

The computer 302 can receive requests over network 330 from a client application (for example, executing on another computer 302). The computer 302 can respond to the received requests by processing the received requests using software applications. Requests can also be sent to the computer 302 from internal users (for example, from a command console), external (or third) parties, automated applications, entities, individuals, systems, and computers.

Each of the components of the computer 302 can communicate using a system bus 303. In some implementations, any or all of the components of the computer 302, including hardware or software components, can interface with each other or the interface 304 (or a combination of both) over the system bus 303. Interfaces can use an application programming interface (API) 312, a service layer 313, or a combination of the API 312 and service layer 313. The API 312 can include specifications for routines, data structures, and object classes. The API 312 can be either computer-language independent or dependent. The API 312 can refer to a complete interface, a single function, or a set of APIs.

The service layer 313 can provide software services to the computer 302 and other components (whether illustrated or not) that are communicably coupled to the computer 302. The functionality of the computer 302 can be accessible for all service consumers using this service layer. Software services, such as those provided by the service layer 313, can provide reusable, defined functionalities through a defined interface. For example, the interface can be software written in JAVA, C++, or a language providing data in extensible markup language (XML) format. While illustrated as an integrated component of the computer 302, in alternative implementations, the API 312 or the service layer 313 can be stand-alone components in relation to other components of the computer 302 and other components communicably coupled to the computer 302. Moreover, any or all parts of the API 312 or the service layer 313 can be implemented as child or sub-modules of another software module, enterprise application, or hardware module without departing from the scope of the present disclosure.

The computer 302 includes an interface 304. Although illustrated as a single interface 304 in FIG. 3, two or more interfaces 304 can be used according to particular needs, desires, or particular implementations of the computer 302 and the described functionality. The interface 304 can be used by the computer 302 for communicating with other systems that are connected to the network 330 (whether illustrated or not) in a distributed environment. Generally, the interface 304 can include, or be implemented using, logic encoded in software or hardware (or a combination of software and hardware) operable to communicate with the network 330. More specifically, the interface 304 can include software supporting one or more communication protocols associated with communications. As such, the network 330 or the interface's hardware can be operable to communicate physical signals within and outside of the illustrated computer 302.

The computer 302 includes a processor 305. Although illustrated as a single processor 305 in FIG. 3, two or more processors 305 can be used according to particular needs, desires, or particular implementations of the computer 302 and the described functionality. Generally, the processor 305 can execute instructions and can manipulate data to perform the operations of the computer 302, including operations using algorithms, methods, functions, processes, flows, and procedures as described in the present disclosure.

The computer 302 also includes a database 306 that can hold data for the computer 302 and other components connected to the network 330 (whether illustrated or not). For example, database 306 can be an in-memory, conventional, or a database storing data consistent with the present disclosure. In some implementations, database 306 can be a combination of two or more different database types (for example, hybrid in-memory and conventional databases) according to particular needs, desires, or particular implementations of the computer 302 and the described functionality. Although illustrated as a single database 306 in FIG. 3, two or more databases (of the same, different, or a combination of types) can be used according to particular needs, desires, or particular implementations of the computer 302 and the described functionality. While database 306 is illustrated as an internal component of the computer 302, in alternative implementations, database 306 can be external to the computer 302.

The computer 302 also includes a memory 307 that can hold data for the computer 302 or a combination of components connected to the network 330 (whether illustrated or not). Memory 307 can store any data consistent with the present disclosure. In some implementations, memory 307 can be a combination of two or more different types of memory (for example, a combination of semiconductor and magnetic storage) according to particular needs, desires, or particular implementations of the computer 302 and the described functionality. Although illustrated as a single memory 307 in FIG. 3, two or more memories 307 (of the same, different, or combination of types) can be used according to particular needs, desires, or particular implementations of the computer 302 and the described functionality. While memory 307 is illustrated as an internal component of the computer 302, in alternative implementations, memory 307 can be external to the computer 302.

The application 308 can be an algorithmic software engine providing functionality according to particular needs, desires, or particular implementations of the computer 302 and the described functionality. For example, application 308 can serve as one or more components, modules, or applications. Further, although illustrated as a single application 308, the application 308 can be implemented as multiple applications 308 on the computer 302. In addition, although illustrated as internal to the computer 302, in alternative implementations, the application 308 can be external to the computer 302.

The computer 302 can also include a power supply 314. The power supply 314 can include a rechargeable or non-rechargeable battery that can be configured to be either user- or non-user-replaceable. In some implementations, the power supply 314 can include power-conversion and management circuits, including recharging, standby, and power management functionalities. In some implementations, the power supply 314 can include a power plug to allow the computer 302 to be plugged into a wall socket or a power source to, for example, power the computer 302 or recharge a rechargeable battery.

There can be any number of computers 302 associated with, or external to, a computer system containing computer 302, with each computer 302 communicating over network 330. Further, the terms "client," "user," and other appropriate terminology can be used interchangeably, as appropriate, without departing from the scope of the present disclosure. Moreover, the present disclosure contemplates that many users can use one computer 302 and one user can use multiple computers 302.

Described implementations of the subject matter can include one or more features, alone or in combination.

For example, in a first implementation, a computer-implemented method includes the following. Inflow packers are run into a hole in locked position downhole into a well. A liner top diagnostic tool is run on a drill pipe to a desired depth in the well. A lower-packer-sized ball is dropped into the well to activate a lower inflow packer assembly. A back side of the lower inflow packer assembly is pressure-tested to ensure seal integrity. The lower inflow packer is unset by withdrawing string weight while rotating the string. The drill string is displaced to test fluid to the end of the string, and weight and rotation are applied again to set the lower inflow packer. A Homer plot is established based, at least in part, on an inflow test. A deactivation-sized ball is dropped into the well to deactivate the lower include packer assembly. An upper inflow packer assembly is activated using upper-packer-sized ball. A leak is identified based, at least in part on testing both liner tops.

The foregoing and other described implementations can each, optionally, include one or more of the following features:

A first feature, combinable with any of the following features, the method further including pulling the string out-of-hole after both liner tops are tested.

A second feature, combinable with any of the previous or following features, the method further including dropping a lower-packer-sized ball to activate a lower inflow packer into the well assembly before activating the lower inflow packer.

A third feature, combinable with any of the previous or following features, the method further including increasing pressure to shear an activation plate and unlock a J-slot after the lower-packer-sized ball lands in the ball seat.

A fourth feature, combinable with any of the previous or following features, where dropping the lower-packer-sized ball to activate a lower inflow packer includes rotating the string counter-clockwise and setting weight down to cause packer elements to be pushed outwards.

A fifth feature, combinable with any of the previous or following features, where rotating the string is done clockwise to re-engage the J-slot and to allow the packer elements to relax.

A sixth feature, combinable with any of the previous or following features, the method further including picking up the string and rotating the string clockwise to retract the packer.

In a second implementation, a non-transitory, computer-readable medium stores one or more instructions executable by a computer system to perform operations including the following. Inflow packers are run into a hole in locked position downhole into a well. A liner top diagnostic tool is run on a drill pipe to a desired depth in the well. A lower-packer-sized ball is dropped into the well to activate a lower inflow packer assembly. A back side of the lower inflow packer assembly is pressure-tested to ensure seal integrity. The lower inflow packer is unset by withdrawing string weight while rotating the string. The drill string is displaced to test fluid to the end of the string, and weight and rotation are applied again to set the lower inflow packer. A Homer plot is established based, at least in part, on an inflow test. A deactivation-sized ball is dropped into the well to deactivate the lower include packer assembly. An upper inflow packer assembly is activated using upper-packer-sized ball. A leak is identified based, at least in part on testing both liner tops.

The foregoing and other described implementations can each, optionally, include one or more of the following features:

A first feature, combinable with any of the following features, the operations further including pulling the string out-of-hole after both liner tops are tested.

A second feature, combinable with any of the previous or following features, the operations further including dropping a lower-packer-sized ball to activate a lower inflow packer into the well assembly before activating the lower inflow packer.

A third feature, combinable with any of the previous or following features, the operations further including increasing pressure to shear an activation plate and unlock a J-slot after the lower-packer-sized ball lands in the ball seat.

A fourth feature, combinable with any of the previous or following features, where dropping the lower-packer-sized ball to activate a lower inflow packer includes rotating the string counter-clockwise and setting weight down to cause packer elements to be pushed outwards.

A fifth feature, combinable with any of the previous or following features, where rotating the string is done clockwise to re-engage the J-slot and to allow the packer elements to relax.

A sixth feature, combinable with any of the previous or following features, the operations further including picking up the string and rotating the string clockwise to retract the packer.

In a third implementation, a computer-implemented system includes one or more processors and a non-transitory computer-readable storage medium coupled to the one or more processors and storing programming instructions for execution by the one or more processors. The programming instructions instruct the one or more processors to perform operations including the following. Inflow packers are run into a hole in locked position downhole into a well. A liner top diagnostic tool is run on a drill pipe to a desired depth in the well. A lower-packer-sized ball is dropped into the well to activate a lower inflow packer assembly. A back side of the lower inflow packer assembly is pressure-tested to ensure seal integrity. The lower inflow packer is unset by withdrawing string weight while rotating the string. The drill string is displaced to test fluid to the end of the string, and weight and rotation are applied again to set the lower inflow packer. A Homer plot is established based, at least in part, on an inflow test. A deactivation-sized ball is dropped into the well to deactivate the lower include packer assembly. An upper inflow packer assembly is activated using upper-packer-sized ball. A leak is identified based, at least in part on testing both liner tops.

The foregoing and other described implementations can each, optionally, include one or more of the following features:

A first feature, combinable with any of the following features, the operations further including pulling the string out-of-hole after both liner tops are tested.

A second feature, combinable with any of the previous or following features, the operations further including dropping a lower-packer-sized ball to activate a lower inflow packer into the well assembly before activating the lower inflow packer.

A third feature, combinable with any of the previous or following features, the operations further including increasing pressure to shear an activation plate and unlock a J-slot after the lower-packer-sized ball lands in the ball seat.

A fourth feature, combinable with any of the previous or following features, where dropping the lower-packer-sized ball to activate a lower inflow packer includes rotating the string counter-clockwise and setting weight down to cause packer elements to be pushed outwards.

A fifth feature, combinable with any of the previous or following features, where rotating the string is done clockwise to re-engage the J-slot and to allow the packer elements to relax.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. For example, the signal can be a machine-generated electrical, optical, or electromagnetic signal that is generated to encode information for transmission to a suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatuses, devices, and machines for processing data, including by way of example, a programmable processor, a computer, or multiple processors or computers. The apparatus can also include special purpose logic circuitry including, for example, a central processing unit (CPU), a field-programmable gate array (FPGA), or an application-specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, such as LINUX, UNIX, WINDOWS, MAC OS, ANDROID, or TO S.

A computer program, which can also be referred to or described as a program, software, a software application, a module, a software module, a script, or a code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub-programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory.

Graphics processing units (GPUs) can also be used in combination with CPUs. The GPUs can provide specialized processing that occurs in parallel to processing performed by CPUs. The specialized processing can include artificial intelligence (AI) applications and processing, for example. GPUs can be used in GPU clusters or in multi-GPU computing.

A computer can include, or be operatively coupled to, one or more mass storage devices for storing data. In some implementations, a computer can receive data from, and transfer data to, the mass storage devices including, for example, magnetic, magneto-optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer-readable media (transitory or non-transitory, as appropriate) suitable for storing computer program instructions and data can include all forms of permanent/non-permanent and volatile/non-volatile memory, media, and memory devices. Computer-readable media can include, for example, semiconductor memory devices such as random access memory (RAM), read-only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer-readable media can also include, for example, magnetic devices such as tape, cartridges, cassettes, and internal/removable disks. Computer-readable media can also include magneto-optical disks and optical memory devices and technologies including, for example, digital video disc (DVD), CD-ROM, DVD+/−R, DVD-RAM, DVD-ROM, HD-DVD, and BLU-RAY.

The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated into, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that the user uses. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch-screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back-end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at the application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations. It should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system including a computer memory interoperably coupled with a hardware processor configured to perform the computer-implemented method or the instructions stored on the non-transitory, computer-readable medium.

What is claimed is:

1. A method, comprising:

running inflow packers in a locked position downhole into a well;

running a liner top diagnostic tool (LTDT) in a drill pipe to a desired depth in the well;

dropping, using a string, a lower-packer-sized ball to activate a lower inflow packer into a well assembly;

pressure-testing a back side of the lower inflow packer assembly to ensure a seal integrity;

unsetting the lower inflow packer by withdrawing a string weight while rotating the string;

displacing the string to test fluid to the end of the string, and applying weight and rotation to set the lower inflow packer;

establishing a Horner plot based, at least in part, on performing an inflow test;

dropping a deactivation-sized ball into the well to deactivate the lower inflow packer included in the well assembly;

activating an upper inflow packer assembly using upper-packer-sized balls; and identifying a leak into the well based, at least in part, on testing liner tops.

2. The method of claim 1, further comprising:

pulling the string out-of-hole after the liner tops are tested.

3. The method of claim 1, further comprising:

dropping a lower-packer-sized ball to activate a lower inflow packer into the well assembly before activating the lower inflow packer.

4. The method of claim 1, further comprising:

increasing pressure to shear an activation plate and unlock a J-slot after the lower-packer-sized ball lands in a ball seat.

5. The method of claim 4, wherein dropping the lower-packer-sized ball to activate the lower inflow packer comprises rotating the string counter-clockwise and setting weight down to cause packer elements to be pushed outwards.

6. The method of claim 5, wherein rotating the string is done clockwise to re-engage the J-slot and to allow the packer elements to relax.

7. The method of claim 1, further comprising:

picking up the string and rotating the string clockwise to retract the lower inflow packer.

8. A non-transitory, computer-readable medium storing one or more instructions executable by a computer system to perform operations comprising:

running inflow packers in a locked position downhole into a well;

running a liner top diagnostic tool (LTDT) in a drill pipe to a desired depth in the well;

dropping, using a string, a lower-packer-sized ball to activate a lower inflow packer into a well assembly;

pressure-testing a back side of the lower inflow packer assembly to ensure a seal integrity;

unsetting the lower inflow packer by withdrawing a string weight while rotating the string;

displacing the string to test fluid to the end of the string, and applying weight and rotation to set the lower inflow packer;

establishing a Horner plot based, at least in part, on performing an inflow test;

dropping a deactivation-sized ball into the well to deactivate the lower inflow packer included in the well assembly;

activating an upper inflow packer assembly using upper-packer-sized balls; and identifying a leak into the well based, at least in part, on testing liner tops.

9. The non-transitory, computer-readable medium of claim 8, the operations further comprising:

pulling the string out-of-hole after the liner tops are tested.

10. The non-transitory, computer-readable medium of claim 8, the operations further comprising:

dropping a lower-packer-sized ball to activate a lower inflow packer into the well assembly before activating the lower inflow packer.

11. The non-transitory, computer-readable medium of claim 8, the operations further comprising:

increasing pressure to shear an activation plate and unlock a J-slot after the lower-packer-sized ball lands in a ball seat.

12. The non-transitory, computer-readable medium of claim 11, wherein dropping the lower-packer-sized ball to activate the lower inflow packer comprises rotating the string counter-clockwise and setting weight down to cause packer elements to be pushed outwards.

13. The non-transitory, computer-readable medium of claim 12, wherein rotating the string is done clockwise to re-engage the J-slot and to allow the packer elements to relax.

14. The non-transitory, computer-readable medium of claim 8, the operations further comprising:

picking up the string and rotating the string clockwise to retract the lower inflow packer.

15. A computer-implemented system, comprising:

one or more processors; and a non-transitory computer-readable storage medium coupled to the one or more processors and storing programming instructions for execution by the one or more processors, the programming instructions instructing the one or more processors to perform operations comprising:

running inflow packers in a locked position downhole into a well;

running a liner top diagnostic tool (LTDT) in a drill pipe to a desired depth in the well;

dropping, using a string, a lower-packer-sized ball to activate a lower inflow packer into a well assembly;

pressure-testing a back side of the lower inflow packer assembly to ensure a seal integrity;

unsetting the lower inflow packer by withdrawing a string weight while rotating the string;

displacing the string to test fluid to the end of the string, and applying weight and rotation to set the lower inflow packer;

establishing a Horner plot based, at least in part, on performing an inflow test;

dropping a deactivation-sized ball into the well to deactivate the lower inflow packer included in the well assembly;

activating an upper inflow packer assembly using upper-packer-sized balls; and identifying a leak into the well based, at least in part, on testing liner tops.

16. The non-transitory, computer-readable medium of claim 15, the operations further comprising:

pulling the string out-of-hole after the liner tops are tested.

17. The non-transitory, computer-readable medium of claim 15, the operations further comprising:

dropping a lower-packer-sized ball to activate a lower inflow packer into the well assembly before activating the lower inflow packer.

18. The non-transitory, computer-readable medium of claim 15, the operations further comprising:

increasing pressure to shear an activation plate and unlock a J-slot after the lower-packer-sized ball lands in a ball seat.

19. The non-transitory, computer-readable medium of claim 18, wherein dropping the lower-packer-sized ball to activate the lower inflow packer comprises rotating the string counter-clockwise and setting weight down to cause packer elements to be pushed outwards.

20. The non-transitory, computer-readable medium of claim 19, wherein rotating the string is done clockwise to re-engage the J-slot and to allow the packer elements to relax.

* * * * *